US011203202B1

(12) United States Patent
LeFevre et al.

(10) Patent No.: US 11,203,202 B1
(45) Date of Patent: Dec. 21, 2021

(54) SYSTEM AND METHOD FOR ATTENUATING INK SMEARS ON PRINTHEAD FACEPLATES DURING INKJET PRINTHEAD MAINTENANCE

(71) Applicant: Xerox Corporation, Norwalk, CT (US)

(72) Inventors: Jason M. LeFevre, Penfield, NY (US); David A. VanKouwenberg, Avon, NY (US); Joseph M. Ferrara, Jr., Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/007,172

(22) Filed: Aug. 31, 2020

(51) Int. Cl.
*B41J 2/165* (2006.01)
*B41J 2/14* (2006.01)

(52) U.S. Cl.
CPC ..... *B41J 2/16541* (2013.01); *B41J 2/1433* (2013.01); *B41J 2002/16502* (2013.01)

(58) Field of Classification Search
CPC ..... B41J 2/16541; B41J 2002/16502; B41J 2002/14443; B41J 2/1606; B41J 2/1433
See application file for complete search history.

(56) References Cited

U.S. PATENT DOCUMENTS

2006/0274113 A1 12/2006 Ono
2007/0279451 A1 12/2007 Mizoguchi et al.
2008/0136866 A1* 6/2008 Okamura ..... B41J 2/1606 347/45
2011/0018937 A1 1/2011 McAvoy et al.

FOREIGN PATENT DOCUMENTS

EP 0389217 B1 10/1994
EP 0882593 B1 12/1998
EP 0694400 B1 1/2003

* cited by examiner

*Primary Examiner* — Thinh H Nguyen
(74) *Attorney, Agent, or Firm* — Moore & Beck LLP

(57) ABSTRACT

An inkjet printhead includes a faceplate mounted to a printhead body. The faceplate has a first area in which an array of inkjet nozzle openings is positioned. The area is covered with a hydrophobic coating. A second area of the faceplate outside of the array of inkjet nozzle openings is covered with a first hydrophilic coating that does not contact the hydrophobic coating covering the first area. A third area of the faceplate between the first area and the second area is covered with a second hydrophilic coating. One end of the third area contacts the hydrophobic coating and another end of the third area contacts the first hydrophilic coating to pull ink emitted onto the hydrophobic coating during a purge operation to the second area of the faceplate.

20 Claims, 7 Drawing Sheets

SYSTEM AND METHOD FOR ATTENUATING INK SMEARS ON PRINTHEAD FACEPLATES DURING INKJET PRINTHEAD MAINTENANCE

TECHNICAL FIELD

This disclosure relates generally to inkjet printing systems, and more particularly, to the maintenance of the printheads in such printers.

BACKGROUND

Large scale inkjet printers perform long print runs with little down time and can be used over multiple shifts at a printing facility. During print production, the printheads in these printers require at regular intervals ink purges through the inkjets and a wipe of the printhead faceplates while the ink is still present on the faceplates to maintain proper jetting functionality and good image quality. The coating on the inkjet printheads in these printers is hydrophobic to prevent ink from leaking from the inkjet nozzles onto the faceplates. This hydrophobic coating causes ink to recede from the edges of the inkjet array in the faceplate and form large drips. Additionally, the inkjet nozzles are held at a small negative pressure after ink is expunged during the purge. This negative pressure also results in the ink receding further away from the edges of the inkjet array and back into the nozzles. When the purge is finished, the faceplate is wiped with an elastomeric wiper to remove the purged ink from the faceplate. This wiping occurs after a time delay from the end of the purge sequence due to system constraints within the printer. Consequently, at the beginning of the wipe, an amount ink may not present at the end of the inkjet array where the wipe begins that is sufficient to lubricate the wiper for a smooth wipe of the faceplate. Instead, the ink at the beginning of the wipe smears on the faceplate and this smeared ink can partially close or otherwise impair the nozzles in the array that are located at the start of the wipe. These compromised or non-functional inkjets can result in poor image quality.

Ensuring a quality wipe across the entire inkjet array would be beneficial.

SUMMARY

An inkjet printer includes new printhead coating structure that helps ensure a quality wipe across the entire surface of an inkjet array in a printhead faceplate. The inkjet printer includes a wiper, at least one actuator operatively connected to the wiper, and a controller operatively connected to the at least one actuator. The controller is configured to operate the at least one actuator to move the wiper. The printer also includes at least one printhead having: a printhead body, a faceplate mounted to the printhead body, the faceplate having a first area in which an array of inkjet nozzle openings are positioned so inkjets within the printhead body can eject drops of ink, a hydrophobic coating over the first area of the faceplate, a second area of the faceplate outside of the first area, the second area being covered with a first hydrophilic coating, the first hydrophilic coating covering the second area of the faceplate not contacting the hydrophobic coating in the first area, and a third area of the faceplate that is covered with a second hydrophilic coating, the third area having a first end that contacts the hydrophobic coating covering the first area and a second end that contacts the first hydrophilic coating covering the second area of the faceplate.

A new printhead coating structure helps ensure a quality wipe across the entire surface of an inkjet array in a printhead faceplate. The new printhead includes a printhead body, a faceplate mounted to the printhead body, the faceplate having a first area in which an array of inkjet nozzle openings are positioned so inkjets within the printhead body can eject drops of ink, a hydrophobic coating over the first area of the faceplate, a second area of the faceplate outside of the first area, the second area being covered with a first hydrophilic coating, the first hydrophilic coating covering the second area of the faceplate not contacting the hydrophobic coating in the first area, and a third area of the faceplate that is covered with a second hydrophilic coating, the third area having a first end that contacts the hydrophobic coating covering the first area and a second end that contacts the first hydrophilic coating covering the second area of the faceplate.

A new method of operating an inkjet printer helps ensure a quality wipe across the entire surface of an inkjet array in a printhead faceplate. The new method includes operating a purge system with a controller to connect a pressure source within the purge system to inkjets within a printhead body of a printhead in the inkjet printer to emit ink onto a hydrophobic coating on a faceplate of the printhead and operating at least one actuator with the controller after a predetermined time has expired following the connection of the pressure source to the inkjets to move a wiper through a first area of the faceplate covered with a first hydrophilic coating, a second area of the faceplate covered with a second hydrophilic coating, and a third area of the faceplate in which an array of the inkjet nozzle openings are located, the third area of the faceplate being covered with a hydrophobic coating to clean the faceplate with the emitted ink.

BRIEF DESCRIPTION OF THE DRAWINGS

The foregoing aspects and other features of an inkjet printing system and a new printhead coating structure that helps ensure a quality wipe across the entire surface of an inkjet array in a printhead faceplate are explained in the following description, taken in connection with the accompanying drawings.

DETAILED DESCRIPTION

Figure 1:
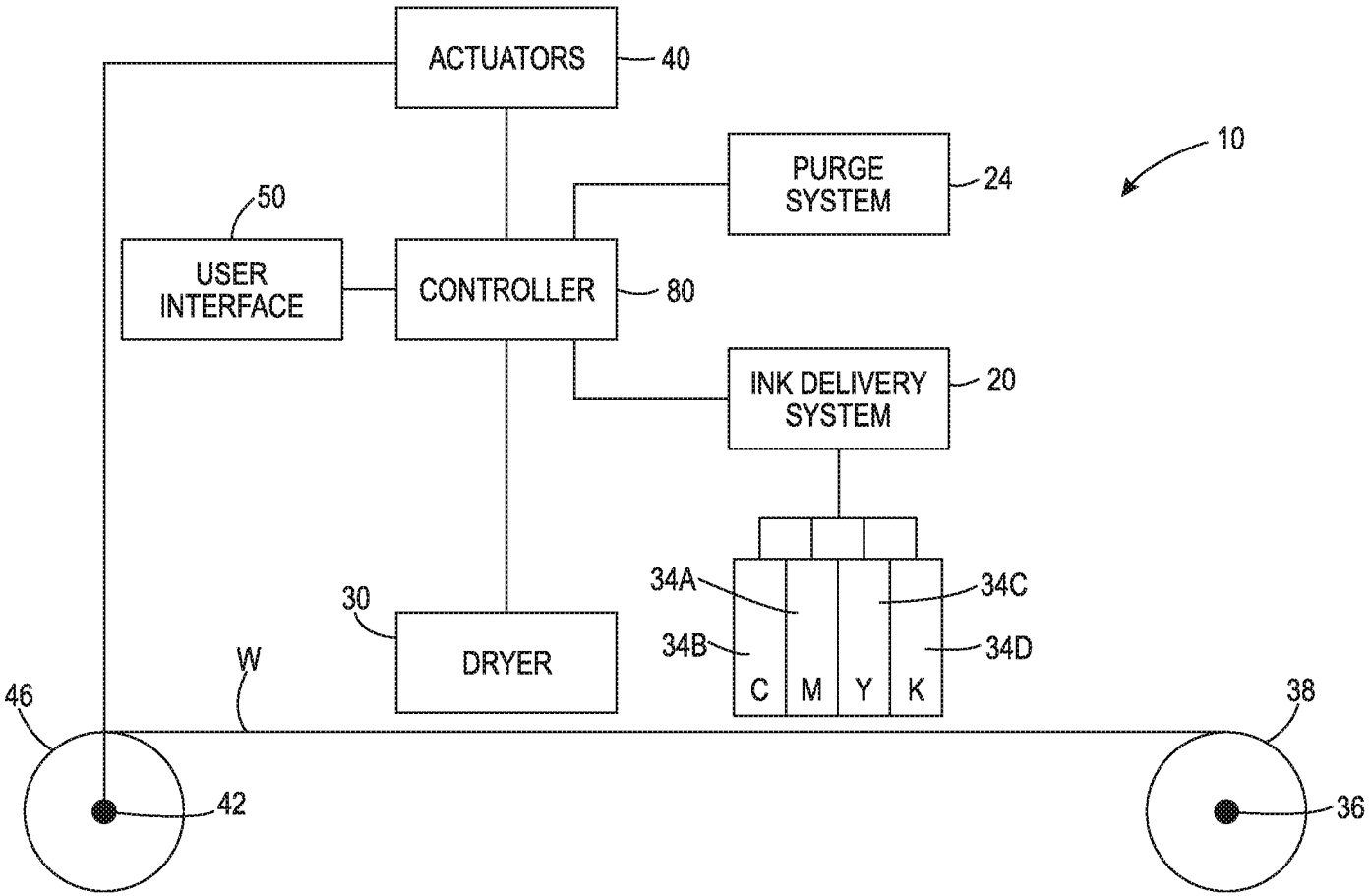
FIG. 1 is a sideview of a printhead assembly in an inkjet printing system that helps ensure a quality wipe across the entire surface of an inkjet array in a printhead faceplate.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction in the plane of the image receiving surface. Also, the description presented below is directed to a system for purging inkjets in an inkjet printer in a manner that reduces the smearing of ink during the wiping of a printhead faceplate after the printhead has been purged. The reader should also appreciate that the principles set forth in this description are applicable to similar imaging devices that generate images with pixels of marking material.

FIG. 1 illustrates a high-speed ink image producing machine or printer 10 in which a controller 80 has been configured to operate the ink delivery system 20 to purge and wipe the inkjets in the printheads 34A, 34B, 34C, and 34D with a reduced risk of ink smear on the printhead faceplate. As illustrated, the printer 10 is a printer that directly forms an ink image on a surface of a web W of media pulled through the printer 10 by the controller 80 operating one of the actuators 40 that is operatively connected to the shaft 42 about which a take up roll 46 is mounted. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that forms images on media wider than a single printhead. Additionally, the printheads can also be interlaced so the density of the drops ejected by the printheads in the cross-process direction can be greater than the smallest spacing between the inkjets in a printhead in the cross-process direction. The printheads 34A, 34B, 34C, and 34D in printer 10 are depicted as being oriented so they eject ink drops downwardly onto the surface of the web W as it passes in the process direction; however, the faceplate coating structure discussed more fully below can also be used with printheads that are oriented in other directions, such as sideways or horizontal ink ejection directions.

The aqueous ink delivery subsystem 20 has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules to emit ink from the printheads during purging. The printhead modules 34A-34D can include associated electronics for operation of the one or more printheads by the controller 80 although those connections are not shown to simplify the figure. Although the printer 10 includes four printhead modules 34A-34D, each of which has two arrays of printheads, alternative configurations include a different number of printhead modules or arrays within a module.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by controller 80 operating one or more actuators 40 to rotate the shaft 42 on which the take up roll 46 is placed to pull the web from the media roll 38 as it rotates about the shaft 36. When the web is completely printed, the take-up roll can be removed from the shaft 42 for additional processing. Alternatively, the printed web can be directed to other processing stations (not shown) that perform tasks such as cutting, collating, binding, and stapling the media. Alternatively, ink images can be printed on individual sheets of media rather than web W.

Operation and control of the various subsystems, components and functions of the machine or printer 10 are performed with the aid of a controller or electronic subsystem (ESS) 80. The ESS or controller 80 is operably connected to the components of the ink delivery system 20, the purge system 24, the printhead modules 34A-34D (and thus the printheads), the actuators 40, and the heater 30. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either a scanning system or an online or work station connection for processing and generation of the printhead control signals output to the printhead modules 34A-34D. Additionally, the controller 80 determines and accepts related subsystem and component controls, for example, from operator inputs via the user interface 50, and accordingly executes such controls. As a result, inks for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2A:
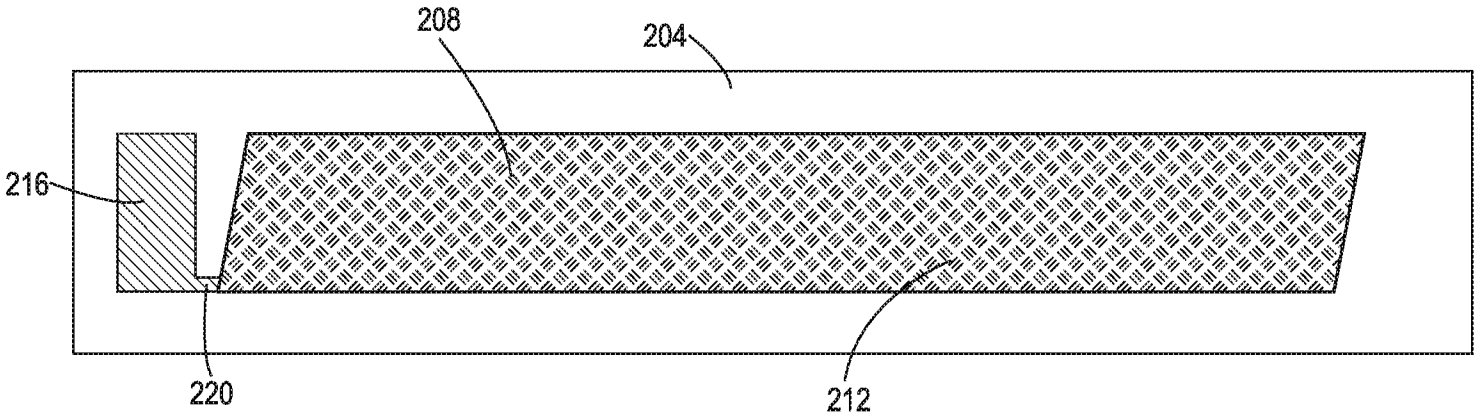
FIG. 2A is a bottom view of one of the faceplates of the printhead shown in FIG. 1.
Figure 2B:
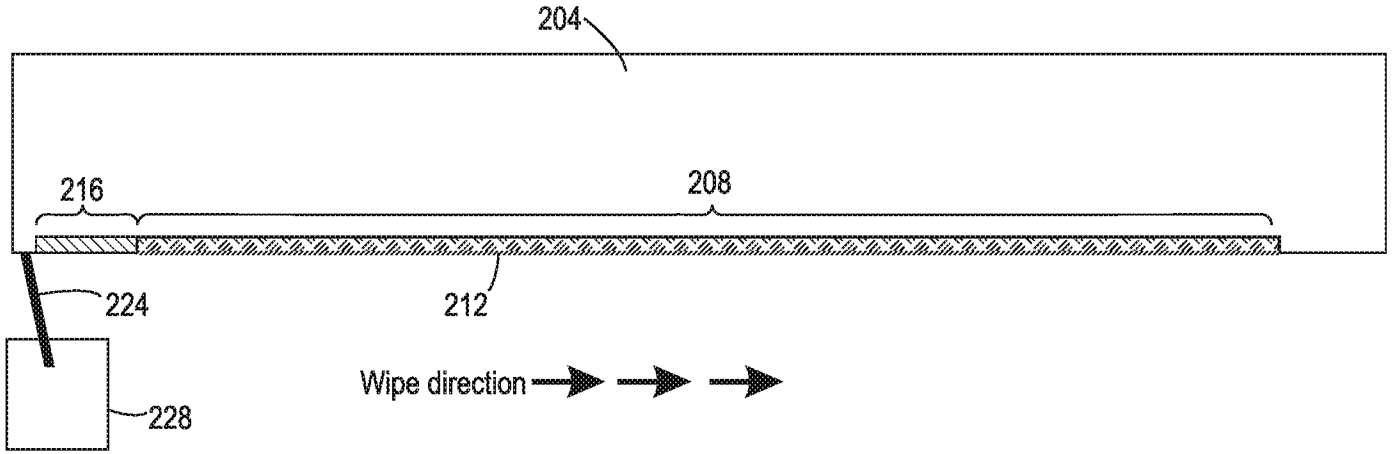
FIG. 2B is a side view of one of printheads shown in FIG. 1.

FIG. 2A and FIG. 2B show the novel structure of the hydrophobic and hydrophilic coatings on the faceplate of one of the printheads 34A, 34B, 34C, and 34D shown in FIG. 1. The faceplate 204 of the printhead 34A is shown in both of the figures. An array of nozzles 208 is formed within the faceplate 204. This array is coated with a hydrophobic coating 212, such as fluorinated silanes and coatings, nano-composites, such as manganese oxide polystyrene and zinc oxide polystyrene, precipitated calcium carbonate, carbon nano-tubes, and silica nano-coatings, as previously known. An area of hydrophilic coating 216 is positioned on the faceplate 204 outside of the inkjet nozzle array 208 and on a side of the array where the wiper is first positioned for wiping the faceplate after a purge operation has been performed. As used in this document, the term "purge operation" means the application of pressure to the inkjets in a printhead that is sufficient to push ink out of the nozzles so the ink spreads across the hydrophobic coating 212 covering the inkjet nozzle array 208. The hydrophilic coatings can be mechanically or chemically roughened metals or plastics. The hydrophilic area 216 is connected by a narrow channel 220 of hydrophilic coating to the hydrophobic coating covering the inkjet nozzle array 208. This channel 220 acts as a capillary to migrate purged ink from the hydrophobic coating 216 to the hydrophilic area 216. In the side view of FIG. 2B, a wiper 224 secured within a holder 228 is depicted at its start position for wiping the faceplate 204 after a purge operation. This view shows that the hydrophilic area 216 has a length along the axis of the wiping that does not reach the start position of the wiper. This length ensures that the wiper 224 does not begin wiping from the hydrophilic area 216 where ink could migrate to the backside of the wiper. Ink on the backside of a wiper can leave ink residue in the inkjet nozzle array 208 that can interfere with the nozzle openings and adversely impact the ejection of ink drops from the inkjets. Additionally, the wiper 224 has a width that is greater that a width of the faceplate 208 along an axis that is perpendicular to the wiping direction and also within the plane of the faceplate. This width helps ensure that all of the purged ink is removed from the faceplate 208 by the movement of the wiper 224 across the faceplate in the direction shown in FIG. 2B.

The hydrophilic channel 220 has a width that provides ink in a range of about 1 to about 5 grams in less than one second to the hydrophilic area 216. This range of ink wets the entire hydrophilic area 216 to a level sufficient to lubricate the wiper so the wiper does not smear ink across the area of the hydrophobic coating on the faceplate first encountered by the wiper. Structuring the channel in this manner so it limits the amount of ink moved to the hydrophilic area 216 also helps avoid the migration of ink from the hydrophilic area 216 to the inkjet array during printing operations. Although the hydrophilic coating of the area 216 and the channel 220 can be the same, in some embodiments, the surface roughness of the channel 220 is less than the area 216 to help prevent ink from migrating from the hydrophilic area 220 to the inkjet array during printing.

Figure 3A:
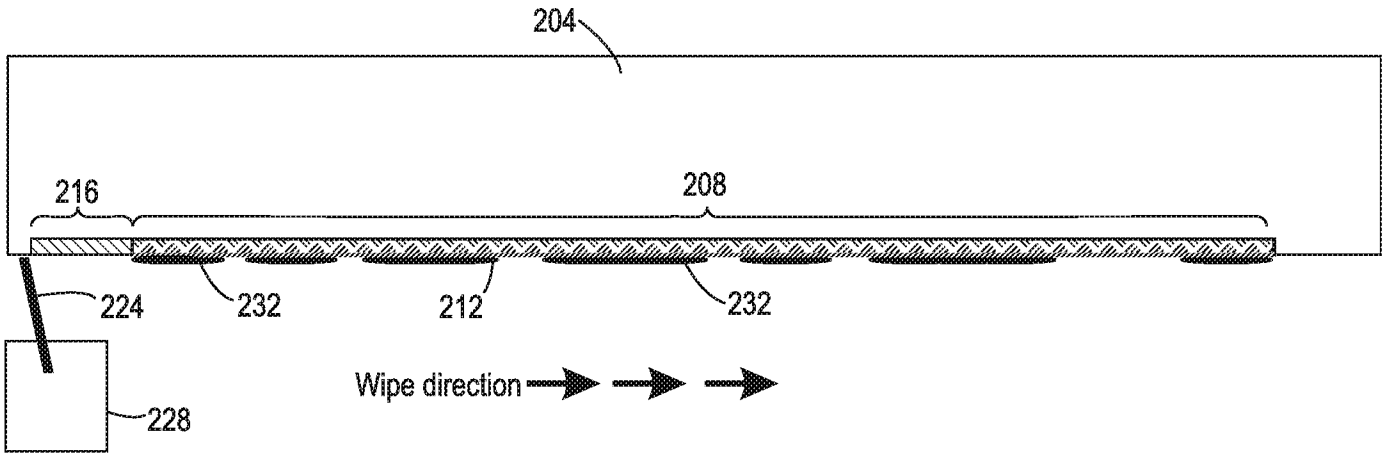
FIG. 3A is a side view of the purging process showing the emitted ink on the inkjet array of the printhead.
Figure 3B:
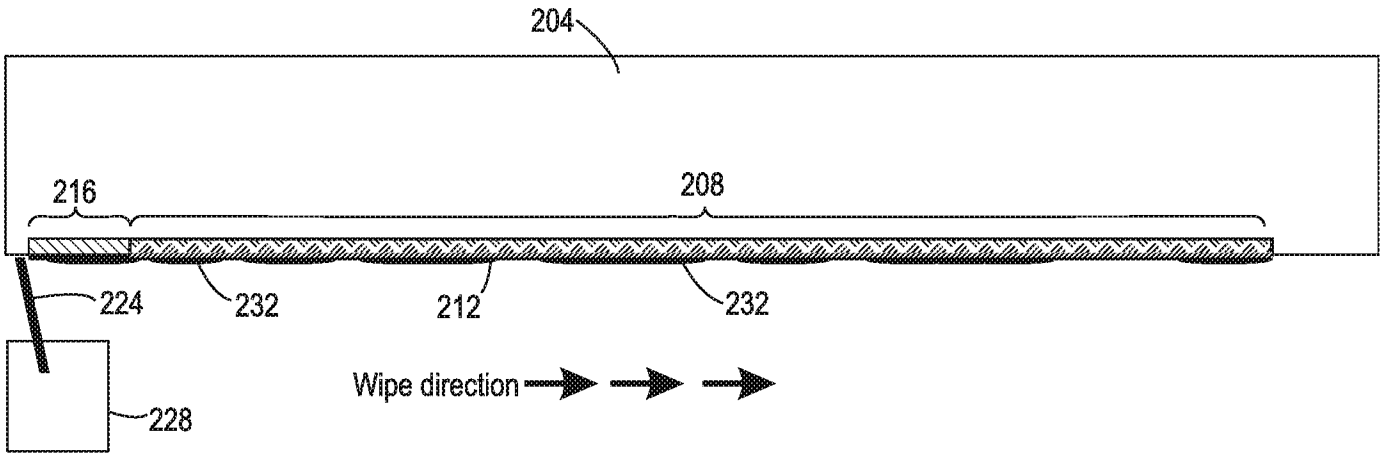
FIG. 3B is a side view of the purging process showing the emitted ink from the inkjet array moving into the hydrophilic area where the wiping begins.
Figure 3C:
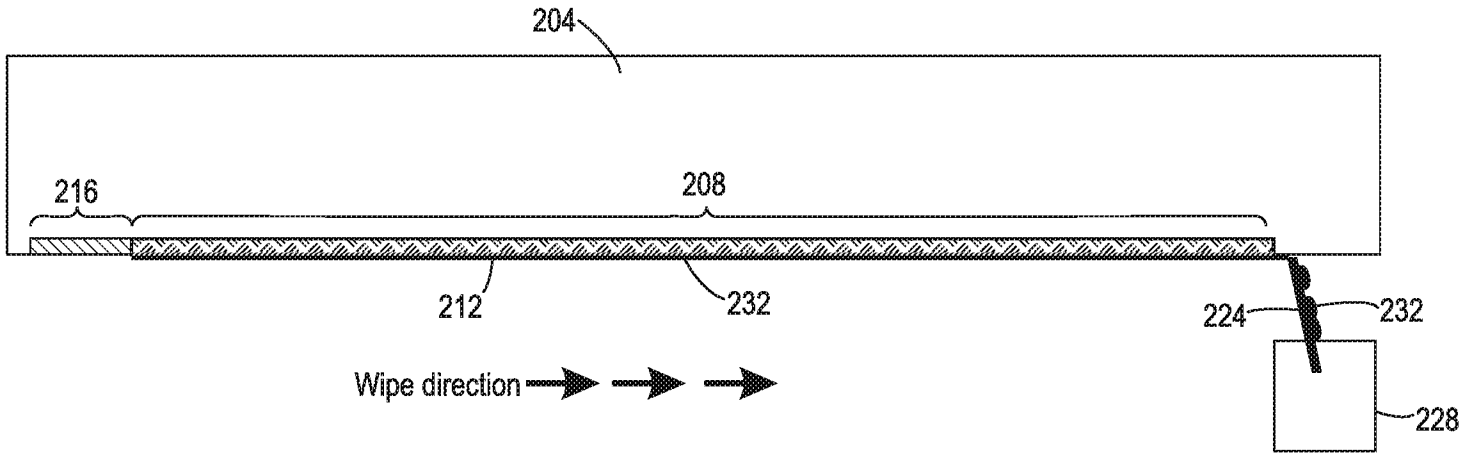
FIG. 3C is a side view of the purging process showing the wiper at the end of its passage across the faceplate after a quality wipe across the entire surface of an inkjet array in a printhead faceplate.

FIG. 3A depicts a side view of a purge operation with the wiper 224 at its start position. The controller 80 connects the ink chambers of the inkjets to a pressure source, such as a pressure source within purge system 20, that applies a pressure sufficient to urge ink 232 out of the inkjet nozzles without ejecting ink drops from the nozzles. As the ink is urged from the inkjet array 208, the ink migrates across the hydrophobic coating 212 on the faceplate 204. In this view, the purged ink has not quite reached the hydrophilic channel 220. In FIG. 3B, the purged ink 232 reaches the hydrophilic channel 220 and is drawn into the hydrophilic area 216. After waiting a predetermined time, which is determined empirically from observation of purge cycles performed on the printhead, the hydrophilic area 216 is covered in ink. After this predetermined time period has expired, as shown in FIG. 3C, the controller 80 operates an actuator operatively connected to the wiper holder 228 to move the wiper from its start position outside of the hydrophilic area 216 through the hydrophilic area and across the length of the faceplate 204 to remove the purged ink and clean the faceplate. The presence of the hydrophilic area 216 enables the wiper to be sufficiently wetted prior to contacting the hydrophobic coating 212 of the inkjet nozzle array 208 so the wiper does not smear ink at the portion of the inkjet nozzle array where the wiping action begins. This improved wiping helps restore the operational capabilities of the inkjets so the printer can remain operational following the purge operation.

Figure 4:
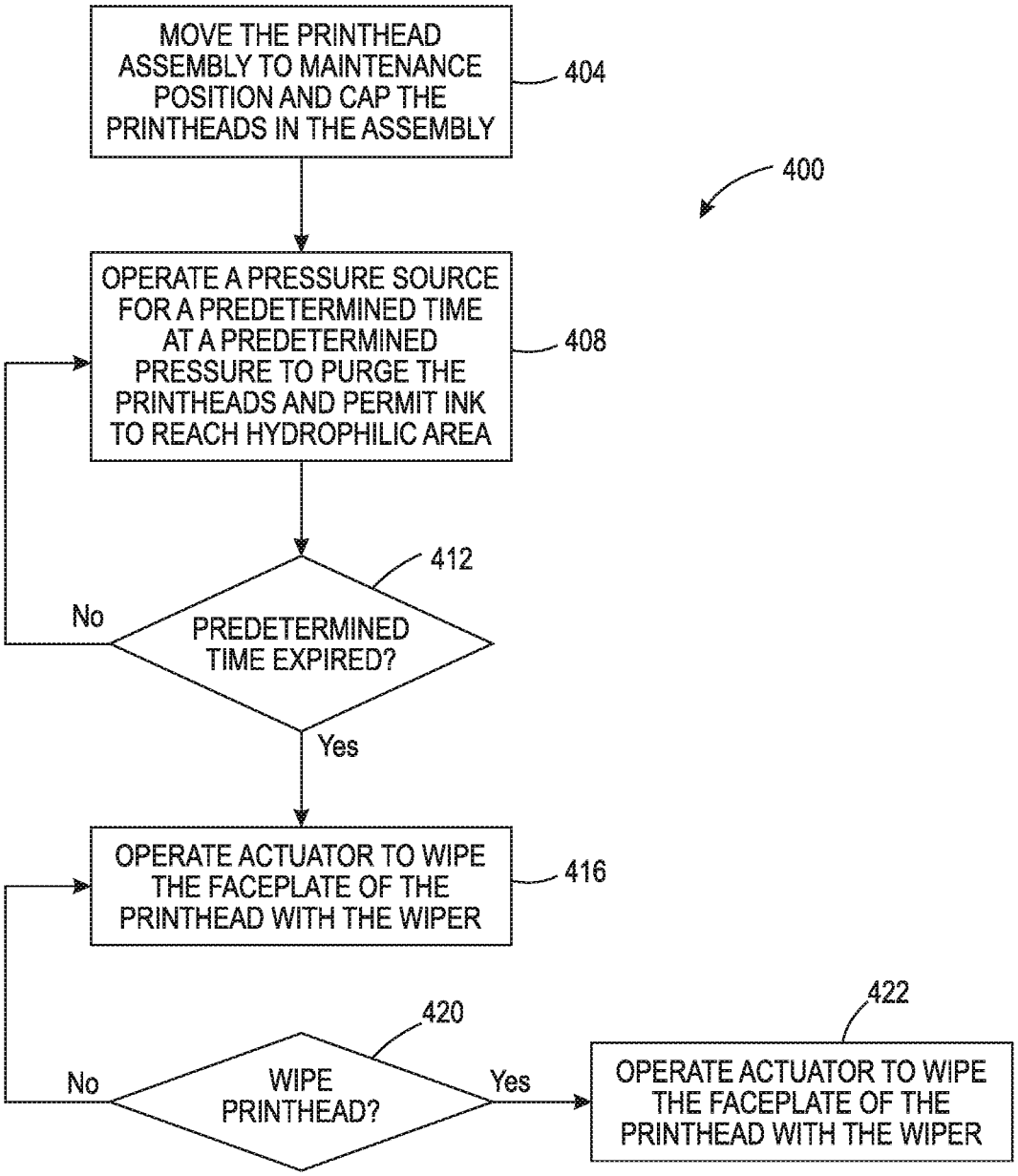
FIG. 4 is a flow diagram of a process for purging inkjets in a printhead and cleaning faceplate of a printhead.

A process 400 for purging and wiping a faceplate of a printhead in the printer 10 in manner that helps ensure a quality wipe across the entire surface of an inkjet array in a printhead faceplate is shown in FIG. 4. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 80 noted above can be such a controller or processor. Alternatively, the controller can be implemented with more than one processor and associated circuitry and components, each of which is configured to form one or more tasks or functions described herein. Additionally, the elements of the method may be performed in any feasible chronological order, regardless of the order shown in the figures or the order in which the processing is described.

The process 400 begins by moving the printhead assembly to its maintenance station and capping the printheads (block 404). A pressure source is then operated by the controller 80 for a predetermined time at a predetermined pressure to purge the inkjets in the printheads and allow the purged ink to be drawn by the channel 220 and cover the hydrophilic area 216 (block 408). After a predetermined time interval has expired (block 412), an actuator is operated by the controller to move the wiper across the faceplate to clean the faceplates of the printheads (block 416). Once the wipe is finished (block 420), the actuator that move the wiper is reversed to return the wiper to its home position (block 424). The wipe is determined to be finished when the wiper passes the last inkjet array in the last printhead to be wiped by the wiper. The printhead assembly is then uncapped and returned to its operational position for printing (block 428).

The incorporation of the hydrophilic area 216 and the hydrophilic channel 220 is most appropriate for downwardly ejecting printheads such as those commonly used in aqueous inkjet printers. With horizontally ejecting printheads, gravity influences the purged ink on the faceplate to migrate to the lower edge of the faceplate where ink collects to form an area where a wiper can be sufficiently wetted before moving upwardly across the faceplate for cleaning. In a downwardly ejecting printhead, which remains level during purging, gravity does not move the purged ink across the printhead. Thus, the hydrophilic channel 220 is needed to facilitate the movement of ink to the hydrophilic area 216 to form a collection of ink sufficient to lubricate the wiper properly.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printhead for an inkjet printer comprising:

a printhead body;

a faceplate mounted to the printhead body, the faceplate having a first area in which an array of inkjet nozzle openings are positioned so inkjets within the printhead body can eject drops of ink;

a hydrophobic coating over the first area of the faceplate;

a second area of the faceplate outside of the first area, the second area being covered with a first hydrophilic coating, the first hydrophilic coating covering the second area of the faceplate not contacting the hydrophobic coating in the first area; and a third area of the faceplate that is covered with a second hydrophilic coating, the third area having a first end that contacts the hydrophobic coating covering the first area and a second end that contacts the first hydrophilic coating covering the second area of the faceplate.

2. The printhead of claim 1 wherein the third area of the faceplate is smaller than the second area of the faceplate.

3. The printhead of claim 2 wherein the third area of the faceplate being configured to provide ink from the first area to the second area of the faceplate in a range of about 1 to about 5 grams of ink in less than one second.

4. The printhead of claim 3 wherein the second area of the faceplate is positioned on a side of the faceplate where a wiper is positioned to wipe the faceplate after a purge operation.

5. The printhead of claim 4 wherein the first hydrophilic coating and the second hydrophilic coating are a same material.

6. The printhead of claim 4 wherein the first hydrophilic coating is a different material than the second hydrophilic coating.

7. The printhead of claim 6 wherein the second hydrophilic coating has a surface roughness that is less than a surface roughness of the first hydrophilic coating.

8. The printhead of claim 7 wherein the first hydrophilic coating and the second hydrophilic coating are mechanically or chemically roughened metal or plastic with different surface roughness.

9. An inkjet printer comprising:

a wiper;

at least one actuator operatively connected to the wiper;

a controller operatively connected to the at least one actuator, the controller being configured to operate the at least one actuator to move the wiper; and at least one printhead having:

a printhead body;

a faceplate mounted to the printhead body, the faceplate having a first area in which an array of inkjet nozzle openings are positioned so inkjets within the printhead body can eject drops of ink;

a hydrophobic coating over the first area of the faceplate;

a second area of the faceplate outside of the first area, the second area being covered with a first hydrophilic coating, the first hydrophilic coating covering the second area of the faceplate not contacting the hydrophobic coating in the first area; and a third area of the faceplate that is covered with a second hydrophilic coating, the third area having a first end that contacts the hydrophobic coating covering the first area and a second end that contacts the first hydrophilic coating covering the second area of the faceplate.

10. The inkjet printer of claim 9 wherein the third area of the faceplate is smaller than the second area of the faceplate.

11. The inkjet printer of claim 10 wherein the third area of the faceplate is configured to provide ink to the second area of the faceplate in a range of about 1 to about 5 grams of ink in less than one second.

12. The inkjet printer of claim 11 wherein the first hydrophilic coating and the second hydrophilic coating are a same material.

13. The inkjet printer of claim 11 wherein the first hydrophilic coating is a different material than the second hydrophilic coating.

14. The inkjet printer of claim 13 wherein the second hydrophilic coating has a surface roughness that is less than a surface roughness of the first hydrophilic coating.

15. The inkjet printer of claim 14 wherein the first hydrophilic coating and the second hydrophilic coating are mechanically or chemically roughened metal or plastic with different surface roughness.

16. The inkjet printer of claim 15 wherein the wiper has a length that is longer than a width of the faceplate along an axis that is perpendicular to a direction of the wiper movement in the plane of the faceplate.

17. The inkjet printer of claim 9 further comprising:

a purge system having a pressure source;

the controller being operatively connected to the purge system, the controller being further configured to:

operate the purge system to connect the pressure source to the inkjets within the printhead body to emit ink onto the hydrophobic coating on the faceplate; and operating the at least one actuator after a predetermined time has expired following the connection of the pressure source to the inkjets to move the wiper to a position that is adjacent to but not contacting the second area and then move the wiper through the second area of the faceplate, the third area of the faceplate, and the first area of the faceplate to clean the faceplate.

18. A method of operating an inkjet printer comprising:

operating a purge system with a controller to connect a pressure source within the purge system to inkjets within a printhead body of a printhead in the inkjet printer to emit ink onto a hydrophobic coating on a faceplate of the printhead; and operating at least one actuator with the controller after a predetermined time has expired following the connection of the pressure source to the inkjets to move a wiper through a first area of the faceplate covered with a first hydrophilic coating, a second area of the faceplate covered with a second hydrophilic coating, and a third area of the faceplate in which an array of the inkjet nozzle openings are located, the third area of the faceplate being covered with a hydrophobic coating to clean the faceplate with the emitted ink.

19. The method of claim 18 further comprising:

operating the at least one actuator with the controller to contact the faceplate without contacting the first hydrophilic coating, the second hydrophilic coating, and the hydrophobic coating.

20. The method of claim 18 further comprising:

providing ink from the first area through the third area to the second area in an amount of about 1 to about 5 grams per second.

* * * * *